US007507166B2

(12) United States Patent
Jung

(10) Patent No.: US 7,507,166 B2
(45) Date of Patent: Mar. 24, 2009

(54) V-SHAPED GOLF CLUB

(76) Inventor: Man-Young Jung, 2750 E. Washington Blvd., Ste 150, Pasadena, CA (US) 91107

( * ) Notice: Subject to any disclaimer, the term of this patent is extended or adjusted under 35 U.S.C. 154(b) by 203 days.

(21) Appl. No.: 11/710,810

(22) Filed: Feb. 24, 2007

(65) Prior Publication Data

US 2008/0207350 A1 Aug. 28, 2008

(51) Int. Cl.
*A63B 53/02* (2006.01)
*A63B 53/04* (2006.01)

(52) U.S. Cl. ..... 473/314; 473/328; 473/335; 473/345; 473/350

(58) Field of Classification Search ..... 473/324–350, 473/219, 226, 242–255, 282, 313–314; D21/733–752, D21/759
See application file for complete search history.

(56) References Cited

U.S. PATENT DOCUMENTS 4,121,833 A * 10/1978 Prueter ..... 473/330
4,141,556 A * 2/1979 Paulin ..... 473/253
4,289,311 A * 9/1981 Smith ..... 473/325
D317,490 S * 6/1991 Pelz ..... D21/744
D331,611 S * 12/1992 Gebhardt ..... D21/743
5,344,151 A * 9/1994 Anderson et al. ..... 473/337
5,494,282 A * 2/1996 Pranio ..... 473/313
5,630,766 A * 5/1997 Granelli ..... 473/313
6,358,162 B1 * 3/2002 Piotrowski et al. ..... 473/404
6,464,598 B1 * 10/2002 Miller ..... 473/314
6,767,292 B1 * 7/2004 Skalla, Sr. ..... 473/251
2003/0232661 A1 * 12/2003 Greer, Jr. ..... 473/340
2008/0254911 A1 * 10/2008 Beach et al. ..... 473/342

* cited by examiner

*Primary Examiner*—Sebastiano Passaniti
(74) *Attorney, Agent, or Firm*—Clement Cheng

(57) ABSTRACT

The golf club is adapted for chip shots and has an upright shaft having a top grip and a bottom end; and a club head having (a) a hosel portion, (b) a trapezoidal clubface with a predetermined angle of loft, a longer leading edge and a relatively short trailing edge, (c) a sole plate having a similar profile to the clubface and defining a bounce angle with respect to a horizontal plane normal to the axis of the shaft, and (d) two opposite side walls in the shape of isosceles triangles for connecting the respective sets of opposing side edges of the clubface and sole plate with the apexes of the triangular side walls pointing away from each other. The leading edge of the clubface defines two acute angled points diverging forwardly of the club head to neutralize rough elements of sand, weed and other barriers and reach out to hit a nestled ball back to the fairway.

16 Claims, 6 Drawing Sheets

V-SHAPED GOLF CLUB

BACKGROUND OF THE INVENTION

A. Field of the Invention

The present invention relates to golf clubs. More particularly, the present invention relates to a highly effective golf club for chipping shots.

B. Description of the Prior Art

A golfer's aim in the tee-box would be to get the ball as close to the green as possible or in the fairway from which the golfer continues to hit the ball towards the green and putt onto the hole. Meanwhile, to make the golf course more challenging it contains areas hard to avoid like the hazards, the rough, and the fringe, which is thick with long grasses. Rough grass area borders the sides of the fairways, the desirable areas to hit the ball from. The hazards are the obstacles dotted around the golf course such as ponds, lakes, creeks, rivers and even an ocean. They also include bunkers or sand traps. The fringe or the collar encircles the green with higher grasses or a line of bushes or trees.

For normal golfers, it is a difficult challenge to escape the hazards and go to the hole which is the great achievement in golf. To solve the hazard problem, golfers choose the special golf clubs named wedges made for a greater accuracy in chipping out of the sand trap or the fairway bunker for example. For chipping, six-iron is also recommended for longer distance to the green. Depending on the degrees of bounce and loft, the two important angular elements in a specific wedge club head design, there are lob wedge, sand wedge and gap wedge for the golfer to choose individually or in a set. In the rough of sand, it has been instructed to make a blast shot by slightly digging some sand from under the ball to pick the ball directly off to the surface.

The respective wedges provide more varied shots than irons with different combinations of the loft angle, bounce and sole width. Generally, a lob wedge has the loft of about 60° with 10°-12° bounce and is called a 60-degree wedge, a sand wedge has the loft about 56° and the bounce of about 12°-14° of ascending sole angle to facilitate an escape from the sand with the sole extending relatively wide.

Standard wedge designs can be found in U.S. Pat. No. 3,079,157 to Turner and U.S. Pat. No. 5,326,105 to Fenton, Jr. These and other known golf clubs and especially, iron type clubs produce a higher ball trajectory with a club head primarily comprising a clubface for hitting the ball with certain loft and a sole, which faces away from the clubface and towards the ground with a camber and an ascending angle of bounce to facilitate dealing with hitting the sand, grass or other golf course elements.

However, the conventional wedges are designed to make blast shots creating rough resistances from sand or vegetations against the club swing. These wedges require complex design considerations to compensate such counteracting tendency and send the ball to an intended height and target area. Thus, sophisticated bounce design were necessary at the sole area of the wedge clubs. In practice, the continual efforts to date with whatever combinations of bounce and loft based on the similar pebble-shaped irons alone has not been satisfactory in actually drawing a ball from the hard to reach physical placement in a rough for the majority of non-professional golfers.

Depending on the position the golf ball is in the bunker, there are lies of varied difficulties between a better lie where the ball sits on a relatively flat surface and a lie called egg fry with a large part of the ball buried deep in the sand.

After the tee shot or a fairway drive the ball often lands outside of the green with a distance such as short 30 yards to the hole. Then, the golfer comes to make a chip or pitch shot. Conventionally, pitch shots are made with less lofted irons like the 5 or 7 iron. Flop shot is a type of chip shot having a very high trajectory before sand or water hazard for instance. Confusions arise around the best strategy with conventional wedges.

It is often instructed to open the clubface and get the club under the ball to pop it up. On the other hand, novice golfers receive a different advice not to open the clubface because the club may not dig in the sand or vegetation sufficiently. As individual golfers are so different, there are as varied skill sets claimed to tackle a rough shot. Or some teaches that only lengthy experiences in the courses improve chip shot skills.

Thus, it is an objective of the present invention to provide an advanced structure of wedge, which swings like a normal iron for chipping a ball and requires no sophisticated club controls for the golfer to master to send the ball constantly to a set trajectory depending on the specified loft and bounce.

It is another objective of the present invention to provide a convenient golf wedge to make and use to overcome a rough situation confidently.

SUMMARY OF THE INVENTION

The primary use of the conventional wedges at a rough area near the green is to chip shot the ball to get onto the green at best. Around the green an irregular vegetation growth is common and sometimes it is overgrown, too soft, soggy, and in a fat bed formation. It may be very short distance to chip the ball but overly hard to cover for casual players, especially a high-handicap golfer.

In case the ball is buried deep in the overgrown grass rather than held on top of it, golfers have found it more difficult to give the desired backspin to such a ball without an extra positional control of the club by opening or closing the clubface which has become redundant according to the present invention.

The long front edge of the present wedge is always ready to engage more difficult balls at odd lies without additional alignment skill required when using the existing wedge clubs. With the novel wedge the golfer may use his normal swing of the iron clubs towards the aimed trajectory and needs not be distracted in making an uncertain face angle at the impact of the chip shot. In other words, through the provision of the extra reaching edge the club eliminates the difficult manipulations of a wedge and may offer a substantially improved consistency in chipping and thus more predictable ball flight.

The golf club according to the present invention is adapted for chip shots comprising: an upright shaft having a top grip and a bottom end; and a club head having (a) a hosel portion for attaching the bottom end of the shaft, (b) a trapezoidal clubface slanted forwardly with a predetermined angle of loft, a longer leading edge and a relatively short trailing edge, (c) a sole plate having a similar profile to the clubface except where the hosel portion integrates therewith and joining at its front edge with the leading edge of the clubface, the sole plate defining a bounce angle with respect to a horizontal plane normal to the axis of the shaft, and (d) two opposite side walls in the shape of isosceles triangles for connecting the respective sets of opposing side edges of the clubface and sole plate with the apexes of the triangular side walls pointing away from each other, whereby the club head has a V shaped side profile with balanced top and bottom sections centered about a middle plane extending between the clubface and the sole plate as well as left and right sections divided by a centerline running between the opposite side walls of the club head.

The club head of the golf club generally has a V-profile laterally and the sole plate is convex, concave or both in part while the clubface is plain or provided with a set of horizontal grooves for putting spin on the ball.

The leading edge of the clubface defines acute angled points diverging forwardly of the club head to neutralize rough elements of sand, weed and other barriers and reach out to hit a nestled ball back to the fairway.

The characteristic V-shaped lateral edges of the present golf club provide a versatile rough-fighting wedge that may provide a greater sole width than prior art wedges', the higher bounce angle of the lob wedges' for an easy gliding of the club out of the rough and a higher degree of loft angle combined with the extended leading edge defining a pointed clubface to reach a deeply lodged ball, which previously troubled the golfers just to make a contact.

Embodiments of the invention will now be described by way of example with reference to the accompanying drawings.

DETAILED DESCRIPTION OF THE PREFERRED EMBODIMENT

Figure 1:
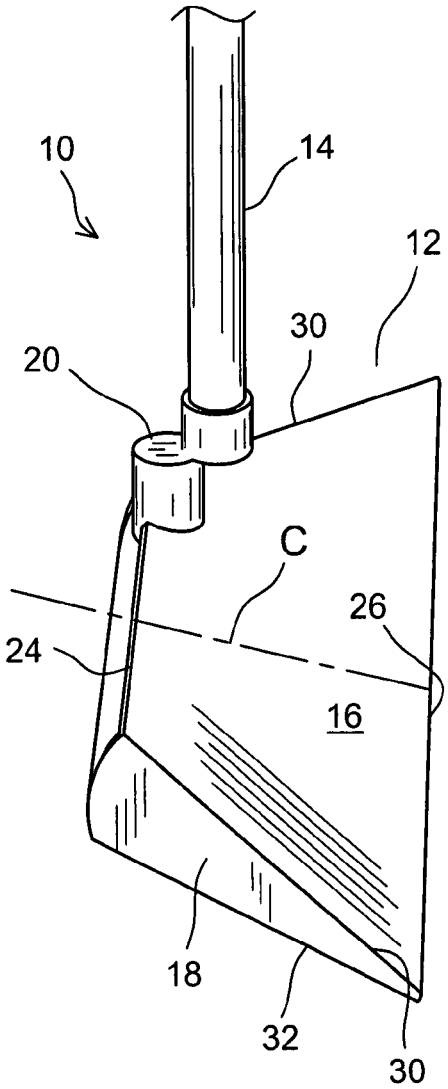
FIG. 1 is a perspective view of a V chip golf club according to an embodiment of the present invention.
Figure 2:
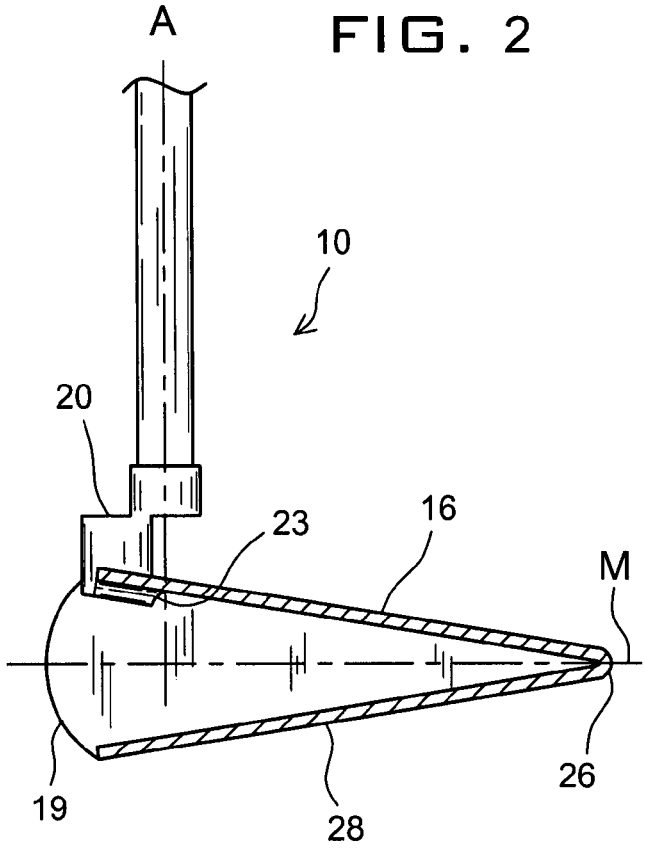
FIG. 2 is a cross sectional view of the V chip golf club of FIG. 1 along a longitudinal centerline of the club head.

With reference to FIGS. 1 and 2, a V chip golf club 10 of the present invention generally has a high-loft club head 12 and a shaft 14. The club head 12 has a trapezoid clubface 16 with triangular side surfaces 18. The shaft 14 may be made of one of known hollow tubular materials and is fixed into a hosel portion 20 formed integral to and protruding from the club head 12. A round junction line 22 may be formed between an area of the clubface and the hosel portion 20. The junction line 22 may be a bore through which the hosel portion 20 penetrates. The bore 22 may be formed partly crossing a trailing edge 24 of the clubface 16. The bore 22 may be provided with a thickened wall section 23 to reinforce attachment of the hosel 20 and shaft 14 to the club head 12. Alternatively, the hosel 20 may be integrally molded or welded to a corner of the a trapezoid clubface 16 close to its leading edge 26 as necessary within the principle of the present invention.

The club head 12 is in a hollow structure having the upper clubface 16 above a similarly shaped sole plate 28 extending from the common leading edge 26 of the clubface 16 rearward at a predetermined angle, which can be chosen to provide a range of sets of bounce and loft correlated to each other as will be described below. For the purpose of dimensional understanding of the club head 12 of the present invention, the leading edge 26 may extends 5.5 inches long with the club face 16 extending 2.5 inches between the leading 26 and trailing 24 edges along the longitudinal centerline C and 2 inches for the trailing edge 24. Each of the opposite side edges 30 of the clubface 16 and the other opposite side edges 32 of the sole plate 28 may be 3 inches long.

In its simpler embodiment shown in FIG. 1, the shape of the sole plate 28 is preferably same as the clubface 16 except its arcuate recess 22. So, the side surfaces 18 may form two isosceles triangles pointing away from each other while extending in plains that are parallel to the axis of the shaft 14. The side surfaces 18 may have arched bases 19, respectively. The trailing edges 24 and arched bases 19 may collectively form a rectangular rear opening of the club head 12. This open void of the club head 12 may be subsequently filled with an optional weight consisting of a flexible frame and rigid insert members custom fitted to help provide the desired weight distributions in the club head. Alternatively, the rectangular opening may be simply blocked by an appropriately shaped plate with the void inside of the club head.

The sole plate 28 may be modified to have shorter trailing edge 24 relative to the opposing trailing edge of the clubface 16 reducing the area of the sole plate 28 to hit the ground at play. In this case, the side surfaces 18 will extend obliquely to the axis of the shaft 14 to chamfer acute peripheral edges against the ground.

While retaining the overall V-profile of the club head 12, the flat sole plate 28 may be modified to be convex, concave or both in part as is well known in the art. On the other hand, the clubface 16 may be plain and/or provided with a set of horizontal grooves that helps in putting spin on the ball. The spin will make the ball fly higher and roll less when it lands.

The golf club head 12 may be made into a single metal structure through casting, investment casting, forging, milling, molding, etc or by a sheet metal technique involving welding processes and then finishing grinds.

Figure 3:
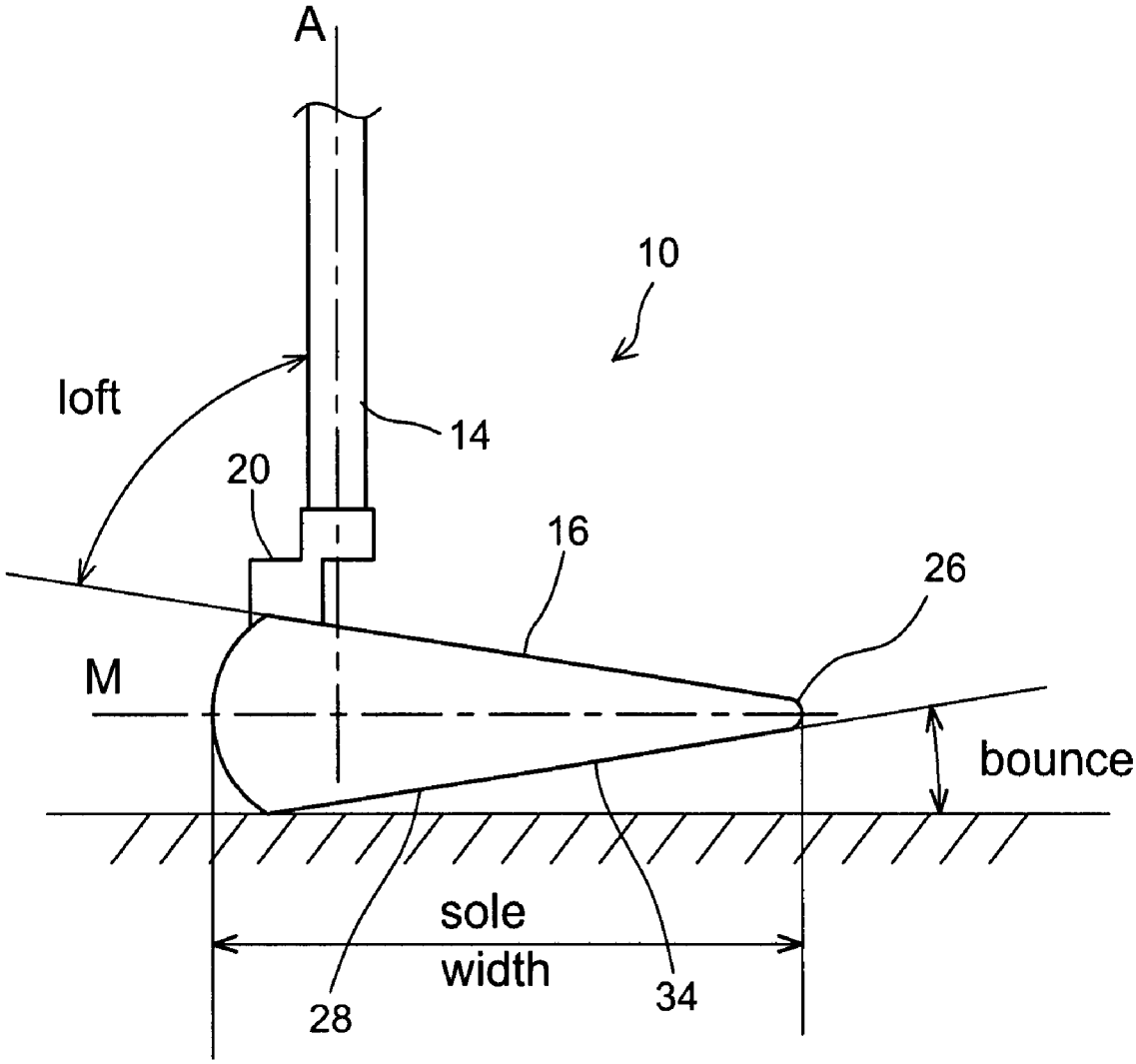
FIG. 3 is a side elevational view showing the angular elements of the V chip golf club.

Referring to FIG. 3, the exemplary figures of the important design elements for the club head 12 will be specified. The clubface 16 may have a high loft of 72°, which is measured with respect to the shaft 14 and is set to pick up a ball from a tough to reach lie in a shot. Although it is not intended to limit the club head 10 to the exact illustrations, the clubface 16 and sole plate 28 are equally angled from the middle plane M, which is equally distanced from the clubface 16 and the sole plate 28 and may be normal to the axis A of the shaft 14. When the club 10 is held upright by holding the shaft 14, the sole plate 28 is symmetrical to the clubface 16 about the middle plane M and provides a straight camber 34. As the clubface 16 maintains the 72° of loft upwardly and 18° of angular distance down to the horizontal middle plane M, the symmetrical camber 34 is assigned a bounce angle of 18° as defined by the ascending angle of the camber 34 from the trailing edge 24 of the sole plate 28 above the ground. While maintaining the V shape of the side surfaces 18 a broad spectrum of lofts and bounces may be attained by independently varying the angle of clubface 16 about the leading edge 26 with respect to the vertical shaft 14 and the angle of sole plate 28 about the leading edge 26 with respect to the horizontal floor. For example, if a 60-degree wedge is desired along with the current bounce of 18°, lifting the clubface 16 about the leading edge 26 will suffice in such design variation. In this case, the middle plane M may be correspondingly slanted from the horizon while the axis A of the shaft 14 maintains the vertical posture. The preferable angle of loft of the clubface 16 may span between 60° and 72°. And the bounce angle on the sole plate may fall between 0°-18° to which most golfers are deemed accustomed.

Unlike most other wedges in irregular shapes that have one clubface and a far different camber profile invisible to the player's eyes leaving a room for guessing the exact point of impact with the floor on which the ball is situated, the club head 10 is advantageously symmetrical in two primary orientations to assist even a casual player in recognizing the spatial positions of the various points of the club head during swing of the club. Substantially, the trapezoidal clubface 16 has identical surface sections about its longitudinal centerline C while the clubface 16 itself is symmetrical to the sole plate 28 about the middle line M. Therefore, the club head 12 of the inventive wedge 10 provides a straightforward visual aid for the user to correctly move the club to an effective hit point between the ball and the rough element.

Figure 4:
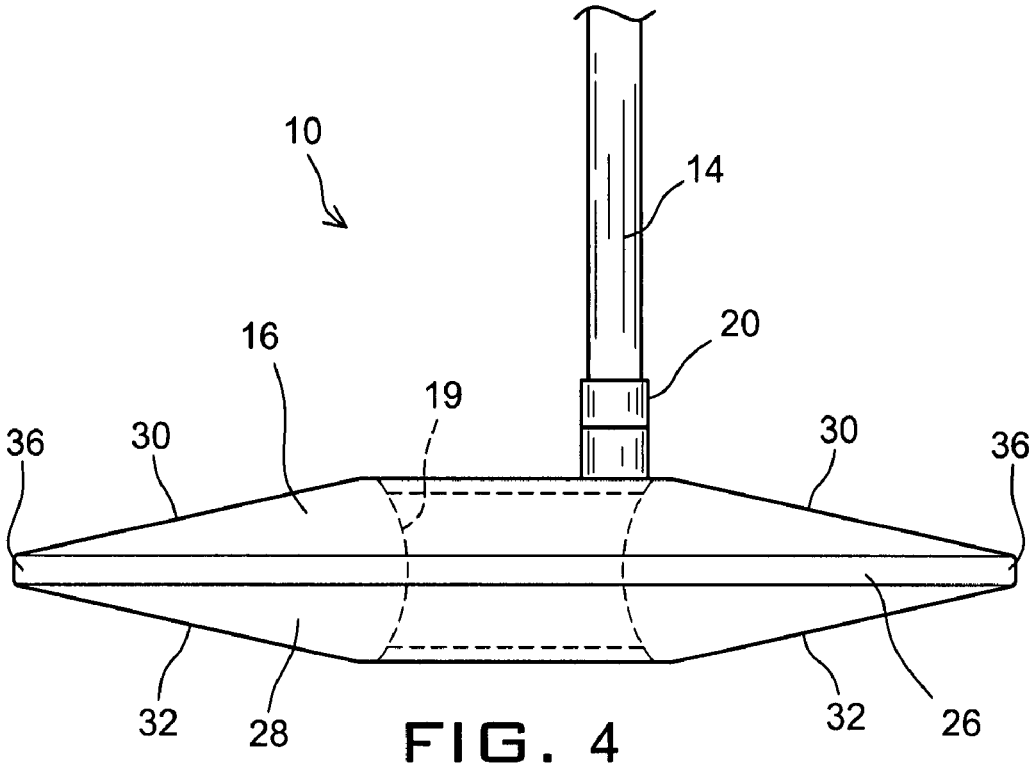
FIG. 4 is a front elevational view of the V chip golf club.
Figure 5:
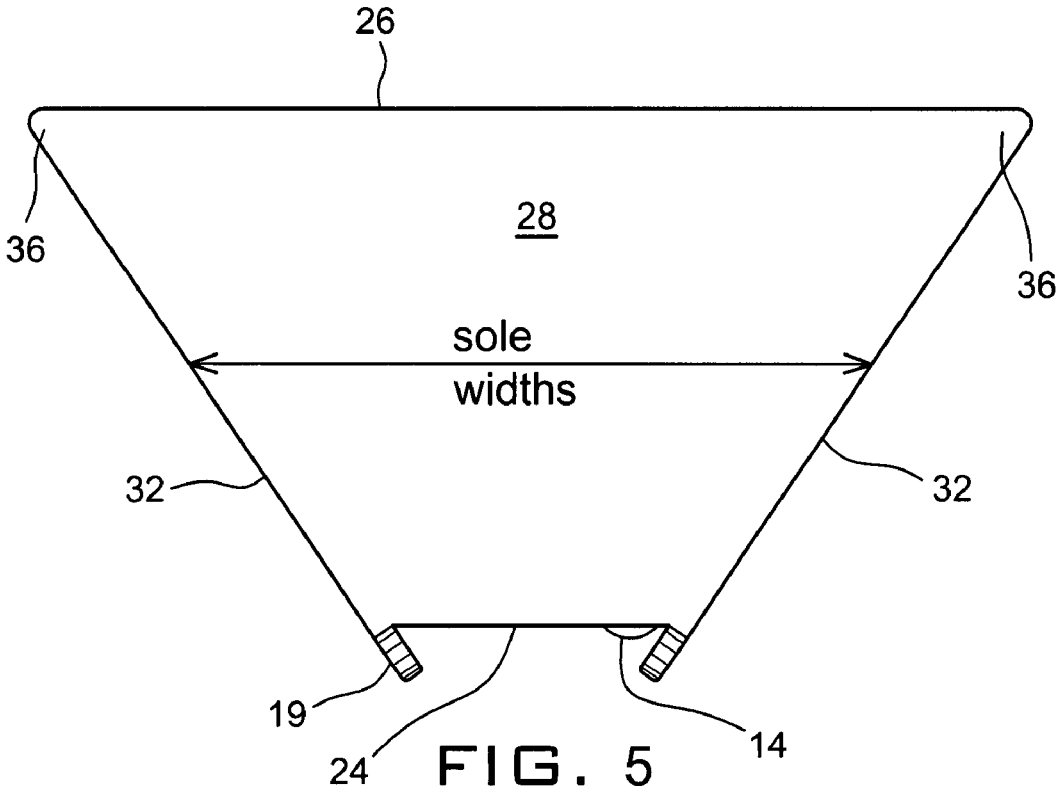
FIG. 5 is a bottom view of the V chip golf club showing the sole area.

Referring to FIGS. 4 and 5 together, the leading edge 26 of the club head 12 is centered vertically of the club 10 in the upright position. Due to the stretched sharp leading edge 26, the club head 12 is ready to make the player's normal swing in a trouble lie of the ball. As the leading edge 26 converges at its opposite ends with the upper and lower side edges 30, 32 of the left and right side surfaces 18, there are formed two sharp end points 36, which diverges forwardly of the club head 12 to neutralize rough elements of sand, weed and other barriers and reach out to hit a nestled ball back to the fairway. The sole width of the sole plate 28 gradually increases toward the leading edge 26.

Figure 6:
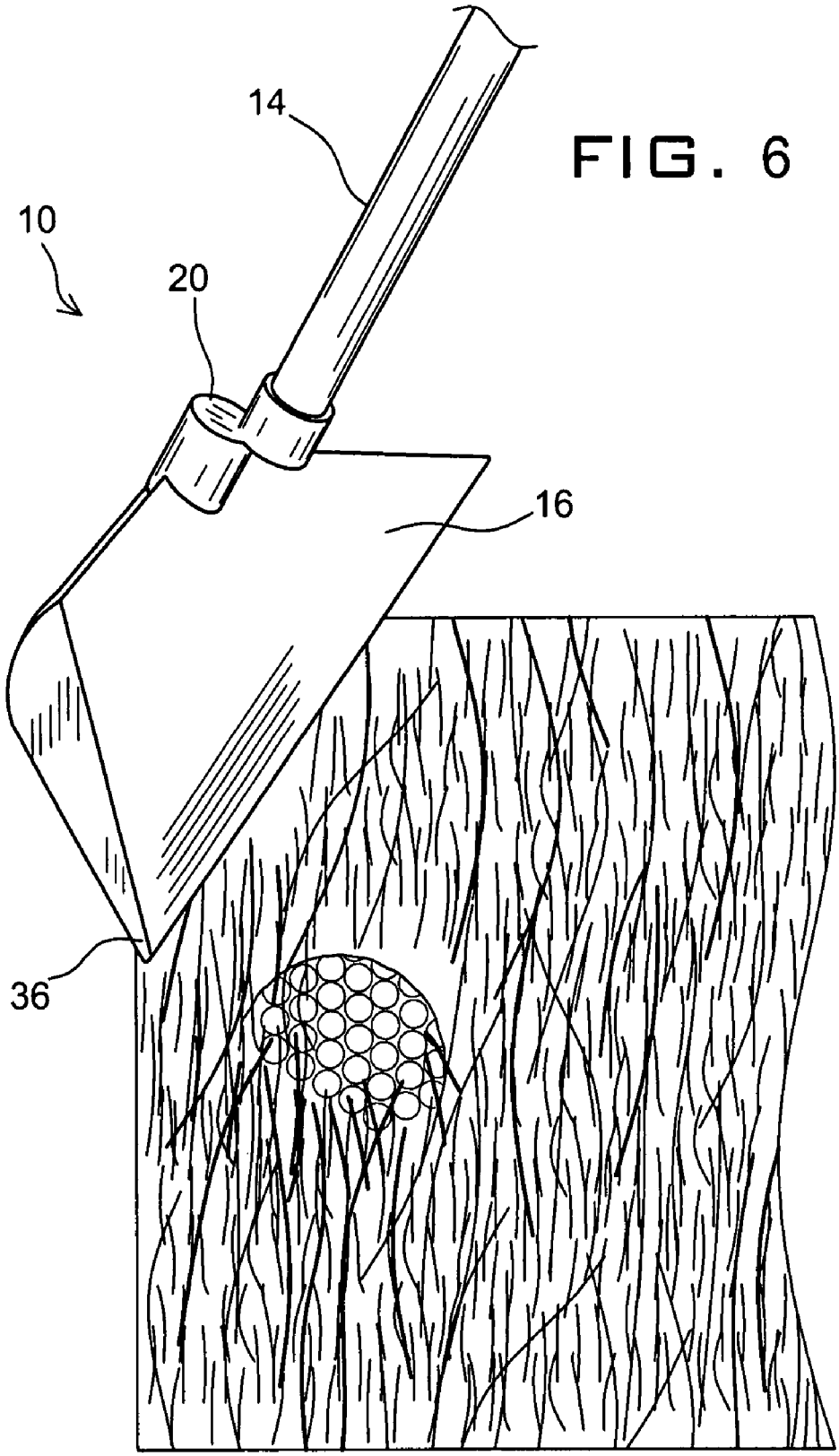
FIG. 6 is a perspective view of the V chip golf club demonstrating its approach towards a sand rough.

As shown in the illustration of FIG. 6, the end points 36 of the club head 12 will physically lead the way through the weeds to the ball in a normal swing that the player would make with his other iron clubs. This saves an extra positional control of the club performed by opening or closing the clubface which has become a mannerism followed by most golfers.

Figure 7:
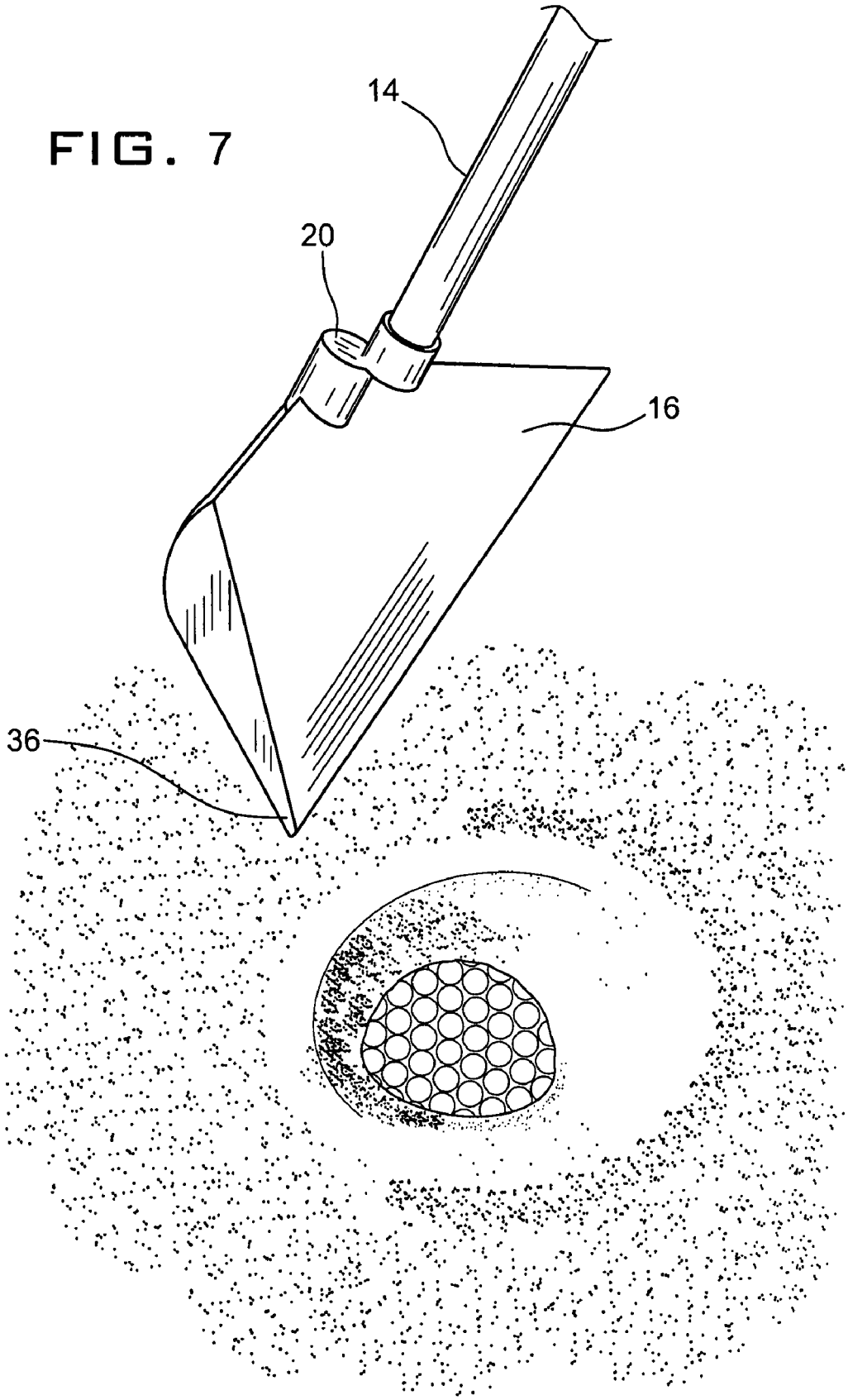
FIG. 7 is a perspective view of the V chip golf club in a chipping near the green. Similar reference numbers denote corresponding features throughout the attached drawings.

The V-chip wedge 10 can also make points at a ball buried deep in the sand of a bunker assuming an egg fry formation as in FIG. 7.

With the novel V-chip wedge of the present invention the player may not be constrained to just get the ball back to the fairway but can advance it directly to the green. The present wedge will send the ball one hundred yards to the green. Therefore, the V-chip wedge club of the present invention can make an effective instrument for such golfers to break through the course troubles. The high loft coupled with the wide sole and long edged face ensures the ball lifted up in the air to an expected height and distance. In addition, the overall shape of the inventive club head is a trapezoid to provide a visually assuring profile to help make one's chipping swing with confidence directly aiming the green.

Figure 8:
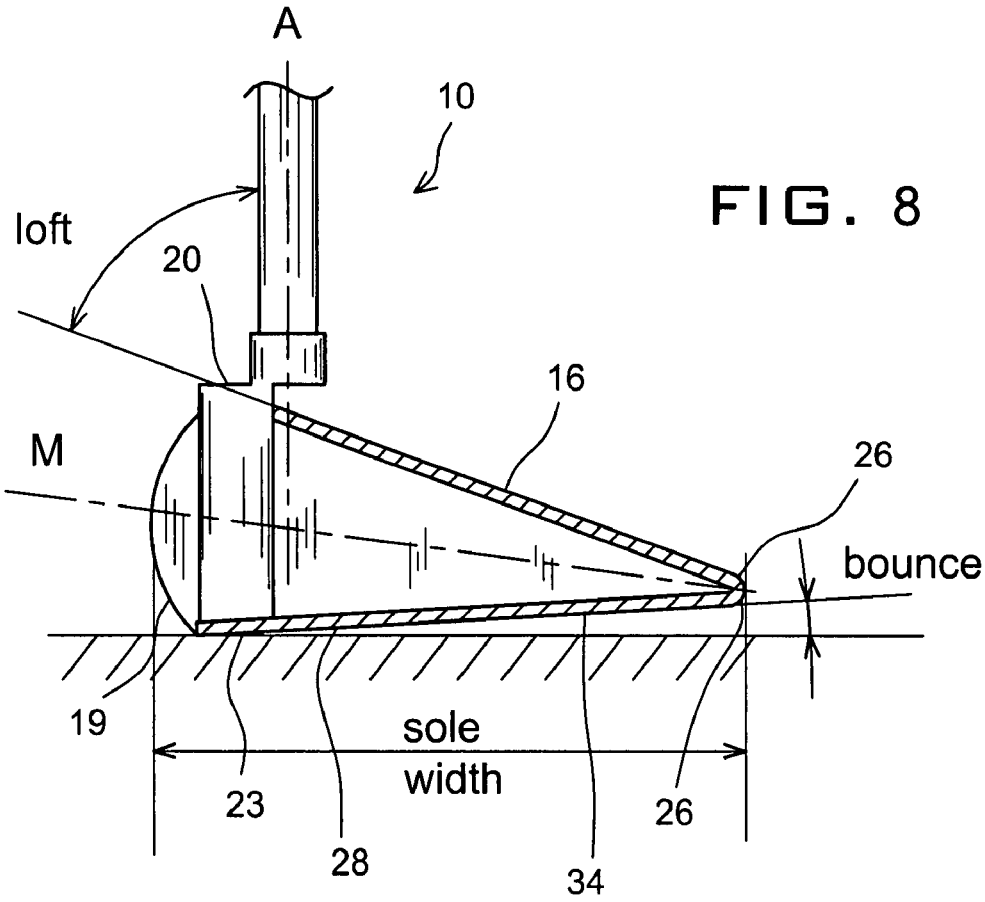
FIG. 8 shows a second embodiment cross-section side view.
Figure 9:
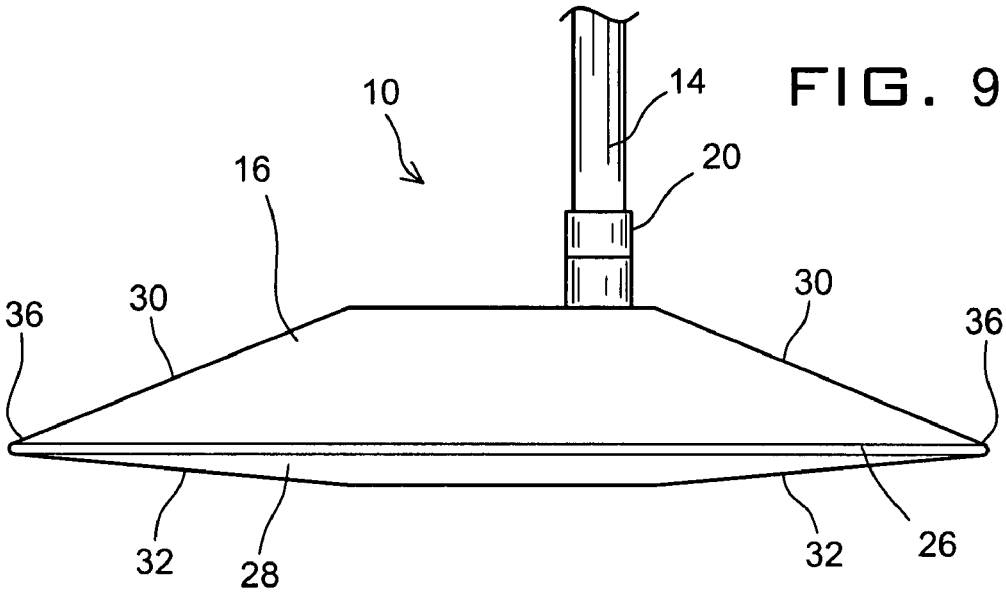
FIG. 9 shows a second embodiment front view.

In a second embodiment of the present invention, as shown in FIGS. 8, 9, the loft angle has been changed so that the bounce of less than 18° provides a different angle such as 5°. The preferable angle of the loft of the clubface 16 may have a different range. The middle plane M is also slanted toward the ground in the second embodiment.

Also, the hosel connection can be made from the top surface of the club head to the bottom of the club head, at a bottom club head surface. The hosel connection is preferably made between the trapezoidal club face 16 and the bottom plate 28.

Therefore, while the presently preferred form of the V chip golf club has been shown and described, and several modifications thereof discussed, persons skilled in this art will readily appreciate that various additional changes and modifications may be made without departing from the spirit of the invention, as defined and differentiated by the following claims.

CALL OUT LIST OF ELEMENTS

10: V Chip Golf Club
12: Club Head
14: Shaft
16: Clubface
18: Side Surface
19: Arched Base
20: Hosel Portion
22: Bore
23: Thick Walled Section
24: Trailing Edge
26: Leading Edge
28: Sole Plate
30,32: Side Edge
34: Straight Camber
36: End Point
A: Axis of Shaft
C: Centerline
M: Middle Plane

The invention claimed is:

1. A golf club for use at chip shots comprising:

an upright shaft having a top grip and a bottom end; and a club head having (a) a hosel portion for attaching the bottom end of the shaft, (b) a trapezoidal clubface slanted forwardly with a predetermined angle of loft, a longer leading edge and a relatively short trailing edge, (c) a sole plate having a similar profile namely a longer leading edge and a relatively short trailing edge to the clubface except where the hosel portion integrates therewith and joining at its front edge with the leading edge of the clubface, the sole plate defining a bounce angle with respect to a horizontal plane normal to the axis of the shaft, and (d) two opposite side walls having a generally triangular shape for connecting the respective sets of opposing side edges of the clubface and sole plate with the apexes of the triangular side walls pointing away from each other, whereby the club head has a V-shaped side profile with balanced top and bottom sections centered about a middle plane extending between the clubface and the sole plate as well as left and right sections divided by a centerline running between the opposite side walls of the club head.

2. The golf club of claim 1, wherein the angle of loft of the clubface is in the order of between 60° and 72°.

3. The golf club of claim 1, wherein the bounce angle on the sole plate is in the order of between 0°-18°.

4. The golf club of claim 1, wherein the leading edge of the club head extends 5.5 inches long with the clubface extending 2.5 inches between the leading and trailing edges of the club head along the longitudinal centerline between the opposite side edges of the clubface and 2 inches for the trailing edge.

5. The golf club of claim 1, wherein the triangular sidewalls have arched bases and the two sets of opposing trailing edges and opposing arched bases collectively form a rectangular rear opening of the club head, and wherein the rectangular rear opening of the club head may be subsequently filled with materials to help provide desired weight distributions in the club head.

6. The golf club of claim 1, wherein the triangular sidewalls have arched bases and the two sets of opposing trailing edges and opposing arched bases collectively form a rectangular rear opening of the club head, and wherein the rectangular opening may be blocked by an appropriately shaped plate with a void inside of the club head.

7. The golf club of claim 1, wherein the club head generally has a V-profile laterally and the sole plate is convex, concave or both in part while the clubface is plain.

8. The golf club of claim 1, wherein the club head generally has a V-profile laterally and the sole plate is convex, concave or both in part while the clubface is provided with a set of horizontal grooves for putting spin on the ball.

9. The golf club of claim 1, wherein the golf club is made into a single metal structure through a method selected from casting, investment casting, forging, milling, molding, or by a sheet metal technique involving welding processes and then finishing grinds.

10. The golf club of claim 1, wherein the two opposite side walls also form a V profile whereby a broad spectrum of lofts and bounces may be attained by manually independently varying the angle of the clubface about the leading edge with respect to the shaft and the angle of the sole plate about the leading edge with respect to the horizon.

11. The golf club of claim 1, wherein the leading edge of the clubface defines acute angled points diverging forwardly of the club head whereby the golf club is capable to neutralize rough elements of sand, weed and other barriers and reach out to hit a nestled ball back to the fairway.

12. The golf club of claim 1, wherein the angle of loft of the clubface is in the order of between 60° and 72°, wherein the bounce angle on the sole plate is in the order of between 0°-18°, wherein the leading edge of the club head extends 5.5 inches long with the clubface extending 2.5 inches between the leading and trailing edges of the club head along the longitudinal centerline between the opposite side edges of the clubface.

13. The golf club of claim 12, wherein the club head generally has a V-profile laterally and the sole plate is convex, concave or both in part while the clubface is provided with a set of horizontal grooves for putting spin on the ball, wherein the golf club is made into a single metal structure through a method selected from casting, investment casting, forging, milling, molding, or by a sheet metal technique involving welding processes and then finishing grinds.

14. The golf club of claim 1, wherein the triangular sidewalls have arched bases and the two sets of opposing trailing edges and opposing arched bases collectively form a rectangular rear opening of the club head, and wherein the rectangular rear opening of the club head may be subsequently filled with materials to help provide desired weight distributions in the club head, wherein the triangular sidewalls have arched bases and the two sets of opposing trailing edges and opposing arched bases collectively form a rectangular rear opening of the club head, and wherein the rectangular opening may be simply blocked by an appropriately shaped plate with the void inside of the club head, wherein the club head generally has a V-profile laterally and the sole plate is convex, concave or both in part while the clubface is plain.

15. The golf club of claim 14, wherein the club head generally has a V-profile laterally and the sole plate is convex, concave or both in part while the clubface is provided with a set of horizontal grooves for putting spin on the ball, wherein the golf club is made into a single metal structure through a method selected from casting, investment casting, forging, milling, molding, or by a sheet metal technique involving welding processes and then finishing grinds, wherein while maintaining the V shape of the side surfaces of the club head a broad spectrum of lofts and bounces may be attained by independently varying the angle of the clubface about the leading edge with respect to the shaft and the angle of the sole plate about the leading edge with respect to the horizon.

16. The golf club of claim 1, wherein the club head generally has a V-profile laterally and the sole plate is convex, concave or both in part while the clubface is provided with a set of horizontal grooves for putting spin on the ball, wherein the golf club is made into a single metal structure through a method selected from casting, investment casting, forging, milling, molding, or by a sheet metal technique involving welding processes and then finishing grinds.

* * * * *